United States Patent [19]

Spound et al.

[11] 4,046,421

[45] Sept. 6, 1977

[54] MODULAR ARTICLE OF FURNITURE

[75] Inventors: Albert M. Spound, Boston; Robert C. Day, Princeton, both of Mass.

[73] Assignee: Charlton Company, Inc., Leominster, Mass.

[21] Appl. No.: 678,961

[22] Filed: Apr. 21, 1976

[51] Int. Cl.[2] ..... A47C 15/00

[52] U.S. Cl. ..... 297/232; 5/131; 297/443

[58] Field of Search ..... 5/51 B, 51 R, 52, 53 R, 5/72, 131; 297/118, 232, 352, 416, 443, 451

[56] References Cited

U.S. PATENT DOCUMENTS

| | | | |
|---|---|---|---|
| 2,793,685 | 5/1957 | Spitz | 297/416 |
| 2,815,067 | 12/1957 | Richardson | 297/443 |
| 2,927,328 | 3/1960 | Rater | 297/416 X |
| 3,841,701 | 10/1974 | Sullivan | 297/443 X |

FOREIGN PATENT DOCUMENTS

| | | | |
|---|---|---|---|
| 677,565 | 3/1950 | United Kingdom | 297/232 |

*Primary Examiner*—James C. Mitchell

*Attorney, Agent, or Firm*—Weingarten, Maxham & Schurgin

[57] ABSTRACT

A modular article of furniture capable of assuming a variety of shapes and configurations and having at least one body support structure having at least one seatrest unit and at least one releasably associated upper body support. The seatrest unit is formed in the geometric shape of either a square, triangle or rhombus, the sides of each individual unit being equal to one another and also equal to the sides of each other individual unit. The seatrest units may be combined and associated with each other and/or with one or more upper body supports to provide variable furniture configurations. The resulting modular article of furniture offers a variable and interchangeable body support structure having a floating appearance and wherein the seat support may comprise a soft-sided cushion arrangement.

14 Claims, 19 Drawing Figures

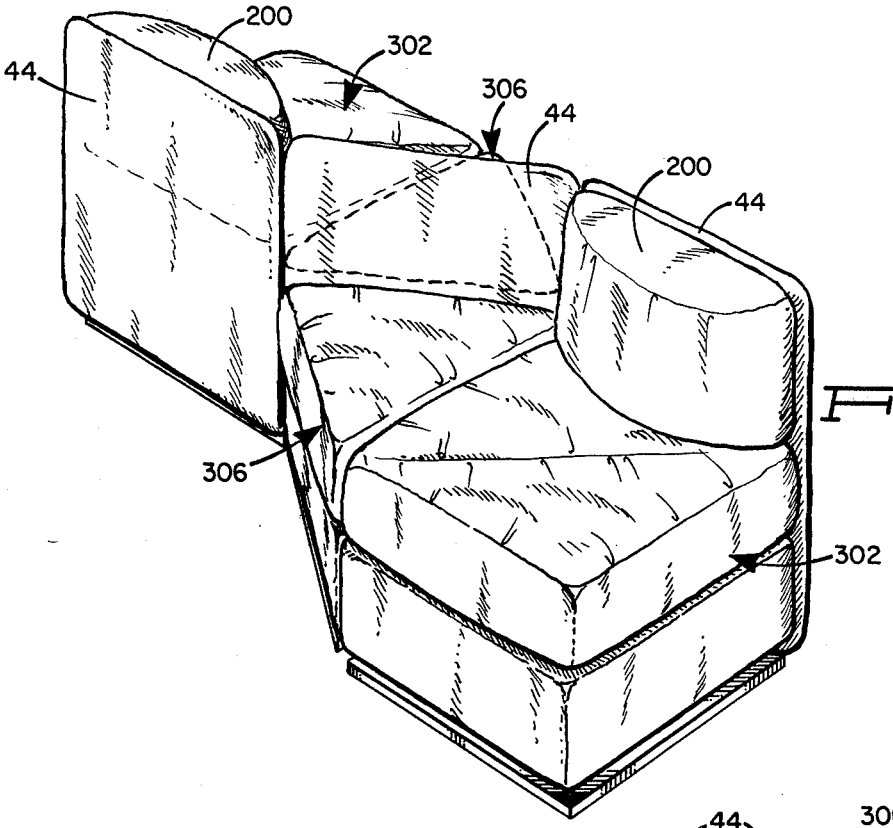
Fig. 12.
Fig. 13a.
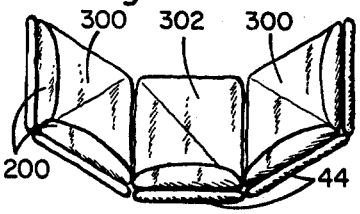
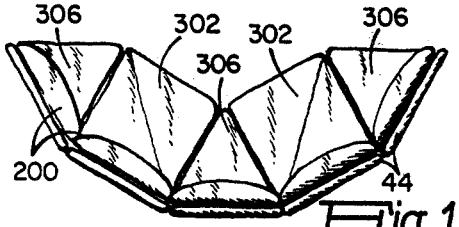
Fig. 13b.
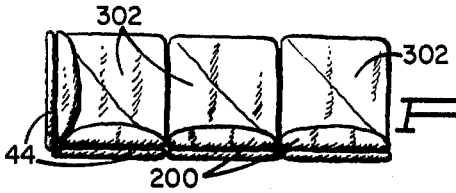
Fig. 13c.
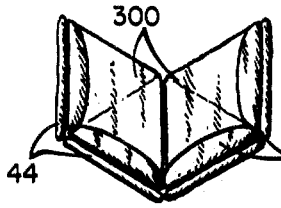
Fig. 13d.
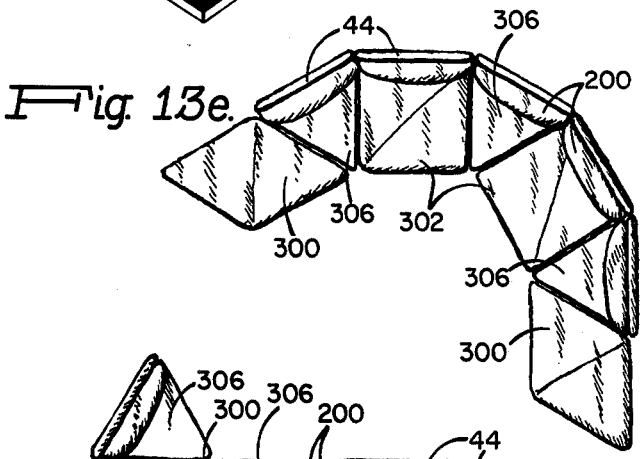
Fig. 13e.
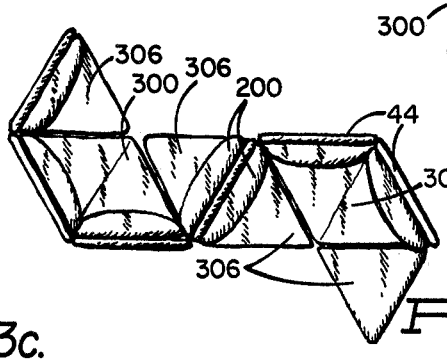
Fig. 13f.
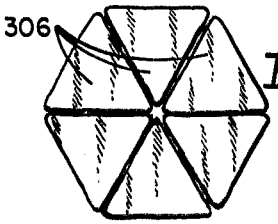
Fig. 13g.

MODULAR ARTICLE OF FURNITURE

FIELD OF THE INVENTION

This invention relates to furniture and more particularly to modular articles of furniture combinable in various useable configurations.

BACKGROUND OF THE INVENTION

Modular furniture typically consists of a seat and backrest arrangement wherein the backrest is either permanently affixed to the seatrest or wherein the backrest and seatrest are associated with a basic frame structure. Usually, the backrest and seatrest are in the form of a rectangular or square, the backrest being permanently affixed to the sides of the seatrest with a variety of means for interconnecting one or more units to form a seating arrangement. Such seating combination is commonly referred to as a couch or playpen. Where the seat and backrest are permanently affixed to one another, there are inherent structural limitations in the construction of the seatrest and possible arrangement thereof with other modular units. Where the seatrest and backrest are not permanently affixed to one another, as typically shown in U.S. Pat. No. 2,793,685, the seatrest and backrest are releasably secured to a base frame to form a basic body support unit. The backrest portion in U.S. Pat. No. 2,793,685, however, is not capable of being interchangeably associated with each side of the seat support portion, and the unit itself is also limited in its possible configuration when associated with similar units.

The concept of modular furniture has evolved to allow a user to individually arrange units in such a way as is most suitable to his or her individual taste, taking into consideration available space. The prior art in providing square or rectangular units wherein the backrest is permanently affixed to the seatrest portion of the modular piece of furniture or wherein the backrest and seatrest portions are releasably secured to a base frame limits the possible modular configurations.

SUMMARY OF THE INVENTION

The present invention has as a primary object the provisions of a versatile, interchangeable, modular article of furniture which is capable of providing a soft-corner seatrest arrangement having a wide variety of individually selectable configurations. Broadly speaking, the versatile, modular article of furniture of this invention comprises a seatrest unit in the form of either a trangle, square or rhombus having sides of equal length, and an upper body support releasably associated therewith. The seatrest unit comprises a planar base of intended geometric shape and adapted to rest on the floor and support and retain in predetermined confronting spaced relationship a seat support. The seat support is of the same geometric configuration as the base and is disposed in confronting spaced relationship to the base to define a predetermined gap therebetween. This gap provides a floating appearance to the completed modular article of furniture, and allows a portion of an upper body support to be inserted within the gap and retained in releasably secured engagement with the base.

The present invention overcomes the limitations of the prior art and offers numerous advantages thereover by providing different distinct geometric seatrest units, each alone having no permanently affixed backrest, but each being so adapted to receive and releasably secure on all sides an interchangeable upper body support. The present invention provides an upper body support structure that may be releasably secured within the predetermined gap to the base, but with no attachment being required to the seat support itself. The absence of an attached upper body support thus allows a seat support to be of a desirable soft-corner, pillow-type construction on all sides.

The geometric shape of the seatrest units provided in the present invention allow a user to arrange individual units in any desired configuration and dispose one or more upper body supports in upstanding relation to any of the exterior sides of the arranged units. The user may easily alter the configuration by removing any one or more of the upper body supports or any of the geometric seat support units to provide a new shape or configuration. Any individual seatrest unit alone may provide what is commonly referred to as an ottoman, or, when combined with one or more upper body supports, may provide a single chair structure. The present invention does not suffer the inherent spatial and arrangement limitations of prior art structure, and, moreover, provides a versatile article of furniture having a modern floating appearance and soft-corner seatrest construction.

The combination of square, triangular and rhombus seatrest units allows the user to build a wide variety of contiguous seatrest arrangements with a minimum amount of individually shaped units. The square, triangular and rhombus seatrest units when associated with one or more upper body supports allows the user to form a wide variety of seatrest units wherein the upper body support is contiguous along the entire extent of the assembled modular article of furniture. The square, triangular and rhombus shapes employed by the invention permit arrangements of modular units even along walls which are joined at acute or obtuse angles as well as at a right angle. In modular furniture of known construction, it is not feasible to provide an effectively continuous back and seat support irrespective of modular arrangement. In this invention, any arrangement can be provided with an effectively continuous back and seat support. Thus, virtually unlimited seating arrangements can be achieved by this invention.

DESCRIPTION OF THE DRAWINGS

These and other features of the present invention are more fully described below in the solely exemplary and non-limiting detailed description and accompanying drawings of which:

FIG. 12 is a perspective view of a modular article of furniture according to the present invention in which two triangular seatrest units and two square seatrest units are associated with one another and with a plurality of upper body supports and pillows to form a reverse curve modular arrangement; and FIGS. 13*a* to 13*g* are diagrammatic representations of a variety of possible arrangements of the modular articles of furniture according to the present invention.

DETAILED DESCRIPTION OF THE INVENTION

Figure 1:
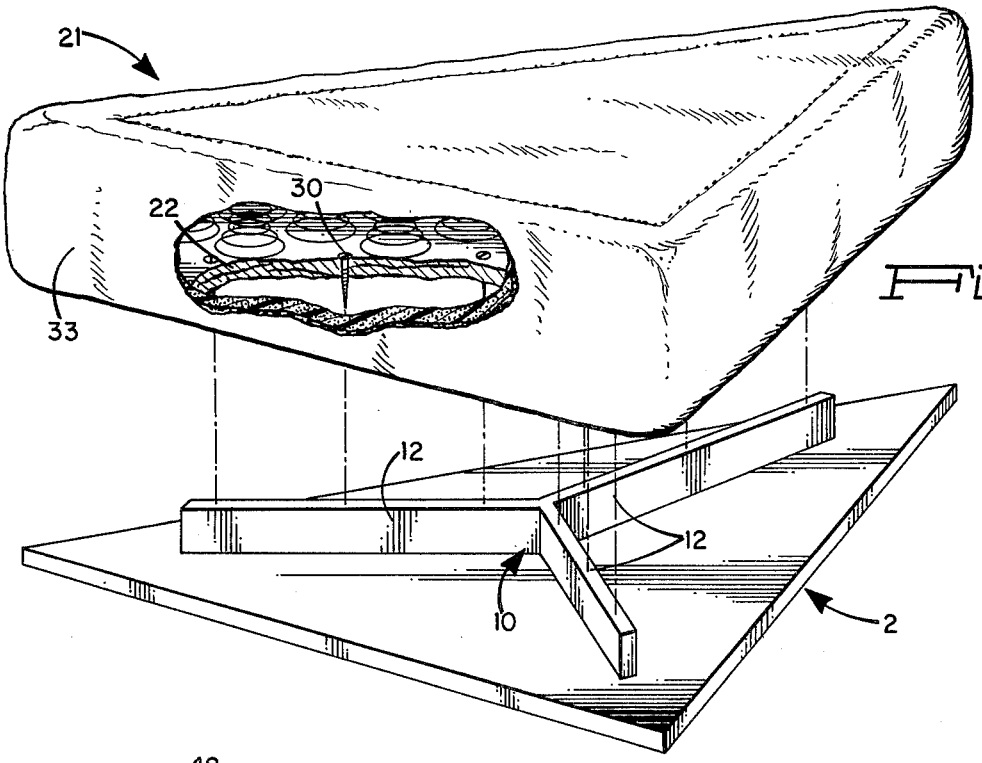
FIG. 1 is a partially cutaway exploded perspective view of a soft-corner seat support, upper body support guides and modular base according to the invention.

With reference now to the drawings, and more particularly to FIGS. 1, 6, 7 and 8, there is shown a base 2 which may be either square, triangular or rhombus in shape having sides all of equal length. Base 2 is typically formed from wood or other suitable material and rests flush on the floor to provide a stable support for the completed modular article on furniture.

Upper body support guide 10 is disposed on the top of base 2 and permanently affixed thereto. Guide 10 is comprised of guide members 12 radially extending outward towards the corners of the base 2. Guide members 12 form a plurality of V-shaped guides each facing respectively the outer edges of the base. On each base, whether square, triangular or rhombus in shape, the V-shaped guides are disposed a predetermined distance from each edge of each base, such distance being substantially equal to the height of triangular support member 40, and the angle formed by the intersection of the guide members of each V-shaped guide is substantially equal to the angle formed by the sides 54 and 56 of triangular support member 40. The V-shaped guides perform a two-fold function. First, the guides direct the triangular support member 40 of upper body support 44 (shown in detail in FIG. 2) into releasably secured engagement and secondly, the guides provide a means for retaining seat support 21 at a predetermined distance above the base.

Seat support 21 comprises a cushion support 33 and a bottom plate 22, the bottom plate typically formed from wood or other suitable material in the same geometric shape as base 2 and disposed on the top of and in confronting spaced relationship to base 2 to define predetermined gap 46. Bottom plate 22 is permanently affixed and secured to guide 10 by screws 30 or other suitable means.

Figure 2:
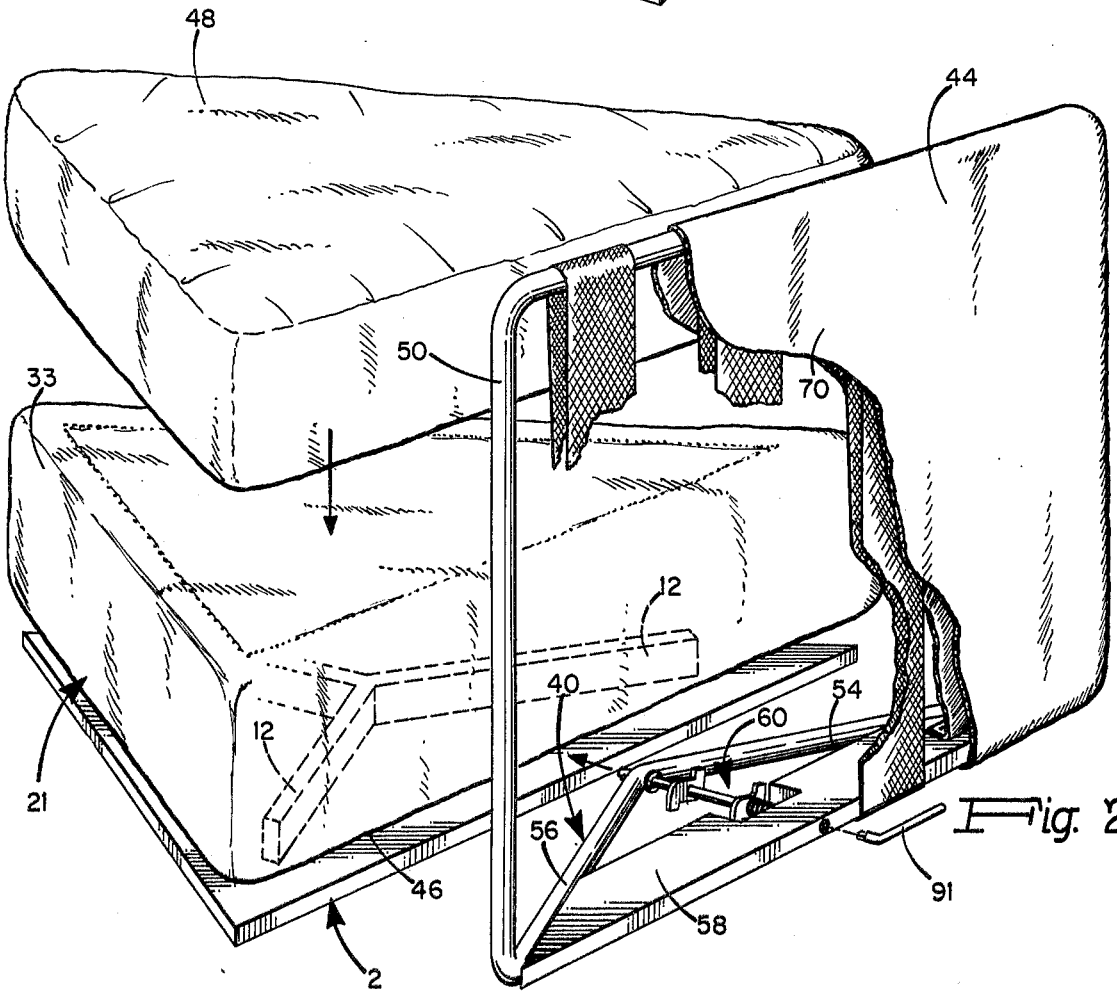
FIG. 2 is a partially cutaway exploded perspective view of a seatrest unit and upper body support according to the invention.

Predetermined gap 46, between base 2 and bottom plate 22, allows upper body support 44, more particularly shown in FIG. 2, to slidably move within gap 46 for releasable engagement with base 2 providing a stable upper body support that is not affixed to or in releasable contact engagement with cushion support 33. This feature allows cushion support 33 to be constructed either of a soft-sided or hard material.

In FIG. 2, cushion 48 is disposed on top of cushion support 33 and formed in the same geometric configuration to provide a seat support. Also shown in FIG. 2 is upper body support 44 comprising rectangular upper body support frame 50 and triangular support member 40 associated therewith and in perpendicular relationship thereto. Upper body support 44 is of a width equal to the side of base 2. Triangular support member 40 comprises sides 54 and 56 and base 58, the angle formed between sides 54 and 56 being substantially equal to the angle formed by the intersection of guide members 12. Triangular support member 40 is so designed to easily move within the predetermined gap 46 and is guided therein by guide members 12. This feature allows the upper body support to be easily positioned within predetermined gap 46 for releasably secured engagement with base 2. It should be noted that the upper body support is adapted to be releasably secured to any side of base 2. Further, a number of upper body supports may be simultaneously releasably secured to base 2 to form a desired modular furniture configuration.

Associated with triangular support member 40 is releasably securing mechanism 60 that releasably secures triangular support member 40 to base 2. FIG. 2 generally shows rectangular upper body support frame 50 and triangular support member 40 as tubular in structure and substantially acting as a frame upon which fabric 70 may be upholstered thereto. However, rectangular upper body support frame 50 and triangular support member 40 may also be formed from a substantially solid unitary structure.

Figure 3:
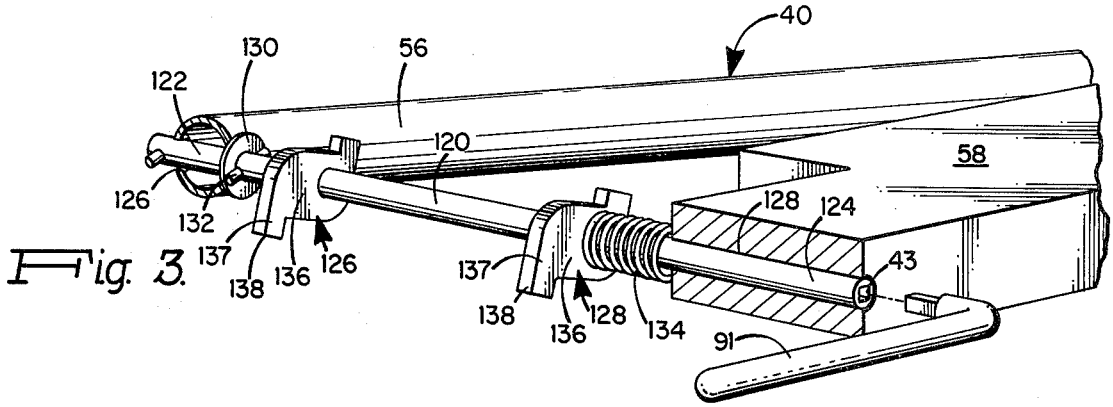
FIG. 3 is a partially cutaway perspective view of a securing mechanism associated with the upper body support in an unsecured position.
Figure 4:
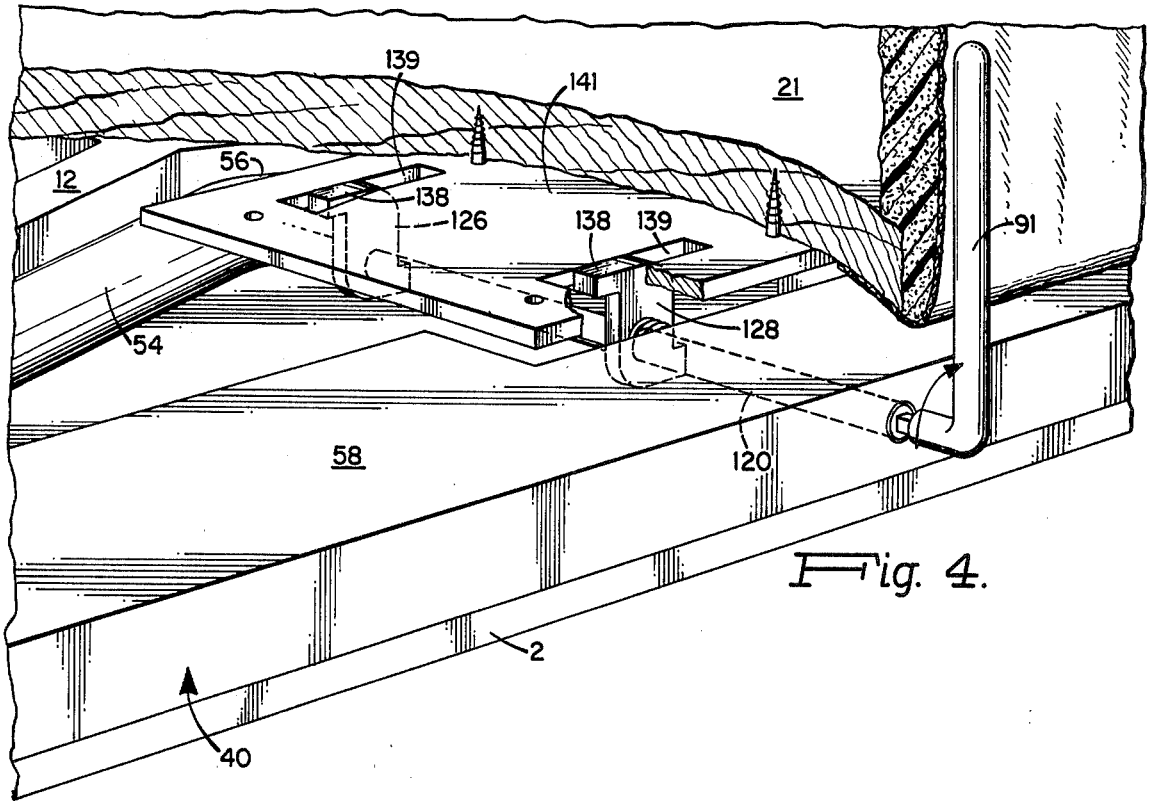
FIG. 4 is a partially cutaway elevation view of the securing mechanism shown in FIG. 3 in the secured position.

In FIG. 3, there is shown an embodiment for releasably securing triangular support member 40 within predetermined gap 46 to base 2. Support rod 120, having end portions 122 and 124, is rotatably disposed between base 58 and the intersection of sides 54 and 56 of triangular support member 40. Cams 126 and 128 are disposed along rod 120 and spaced intermediate base 58 and the intersection of sides 54 and 56. Rod 120 is supported at end portion 122 by transverse bore 126 through triangular support member 40 and further supported at end portion 124 by transverse bore 128 through base 58. Rod 120 is restrained from transverse movement by washer 130 disposed about rod 120 between restraining extensions 132 and the inside surface of sides 54 and 56. Rod 120 is further restrained from transverse movement by biased spring member 134 disposed about rod 120 and intermediate cam 128 and base 58. Cams 126 and 128 are identical in structure each having a generally rectangular planar first portion 136 disposed about rod 120 and affixed thereto in perpendicular relation, and further having a gripping end portion 138 for providing releasable contact engagement with retaining plate 141. As evident from FIGS. 3 and 4, contact surface 137 of gripping end portion 138 engage receiving slots 139 when rotated through an angle of 90° and are restrained from further rotational movement once engaged. End portion 124 is disposed flush with the other surface of base 58 and having recess 43 adapted to receive wrench 91 for turning rod 120. Once triangular support member 40 is inserted within predetermined gap 46, positioning upper body support frame 50 in substantially perpendicular confronting relationship with seat support 21, wrench 91 is inserted into recess 43 and turned clockwise to rotate cams 126 and 128 into contact engagement with retaining plate 141, more specifically shown in FIG. 4.

Figure 5:
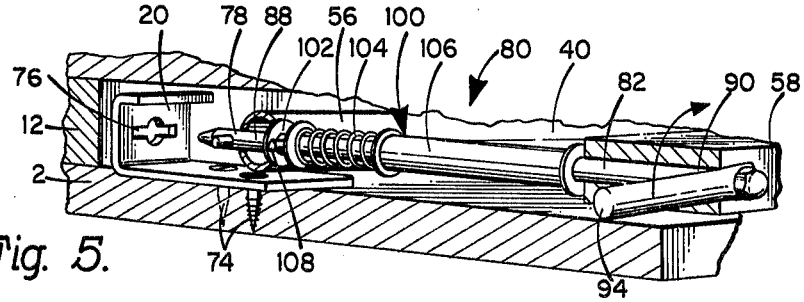
FIG. 5 is a partially cutaway perspective view of an alternative securing mechanism associated with the upper body support according to the present invention and in the unsecured position.
Figure 6:
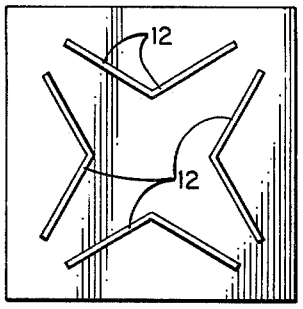
FIG. 6 is a top view of a square base and support guides according to the invention.
Figure 7:
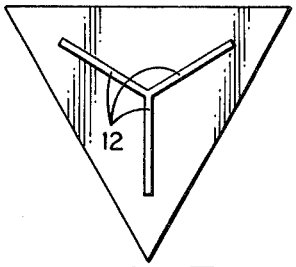
FIG. 7 is a top view of a triangular base and support guides according to the invention.
Figure 8:
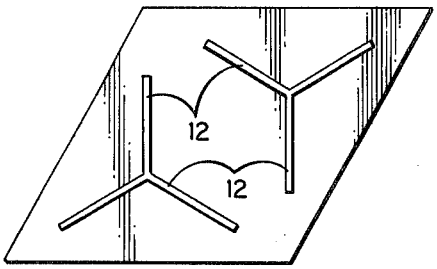
FIG. 8 is a top view of a rhombus base and support guides according to the invention.

In FIG. 5, there is shown an alternative retaining means having retaining bracket 20 affixed to base 2 by screw 74 or similar fastening means, bracket 20 having slotted key opening 76 adapted to receive latch extensions 78 of securing member 80. Securing member 80 is integrally and rotatably associated with triangular support member 40 to provide releasably secured engagement with securing bracket 20. Securing member 80 comprises cylindrical rod 82 having end portions being retained and supported by triangular support member 40. Latch extensions 78 are disposed on end portion 88 of rod 82 and extending in outward perpendicular relationship thereto for insertion into slotted key opening 76 to provide releasably secured engagement of triangular support member 40. Affixed to end portion 90 is actuating turning lever 94. Turning lever 94 is affixed to rod 82, such that the rotation of turning lever 94 through an angle of 90° also causes latch extension to rotate through a similar angle.

Latch extensions 78 are retained at a predetermined distance from triangular support member 40, such distance being slightly greater than the depth of slotted key opening 76. Latch extension is retained at said predetermined spaced relation from triangular support member 40 by retaining apparatus 100. Retaining apparatus 100 comprises washer 102 disposed about rod 82 and in contact relation with sides 54 and 56 of triangular support member 40 and spring retainer 108. Retaining spring 104 is disposed about rod 82 intermediate spring retainer 108 and sleeve 106. Sleeve 106 is disposed along rod 82 and in confronting relationship with spring retainer 108 at one end and triangular support member 40 at the other.

Upper body support 44 may be releasably secured within the predetermined gap to any of the sides of base 2. Typically, triangular support member 40 is inserted into predetermined gap 46 along any side of base 2 and guided into secured engagement with securing bracket 20 by guide members 12. Once positioned in confronting relationship with securing bracket 20, latch extensions 78 are inserted into slotted key opening 76. Lever 94 is then turned through an angle of 90° to rotate latch extensions 78 through a similar angle and thus provide releasably secured engagement of triangular support member 40 to retaining bracket 20. To detach upper body support 44, lever 94 is turned through 90° which in turn positions latch extensions 78 to be withdrawn from slotted key opening 76.

Figure 9:
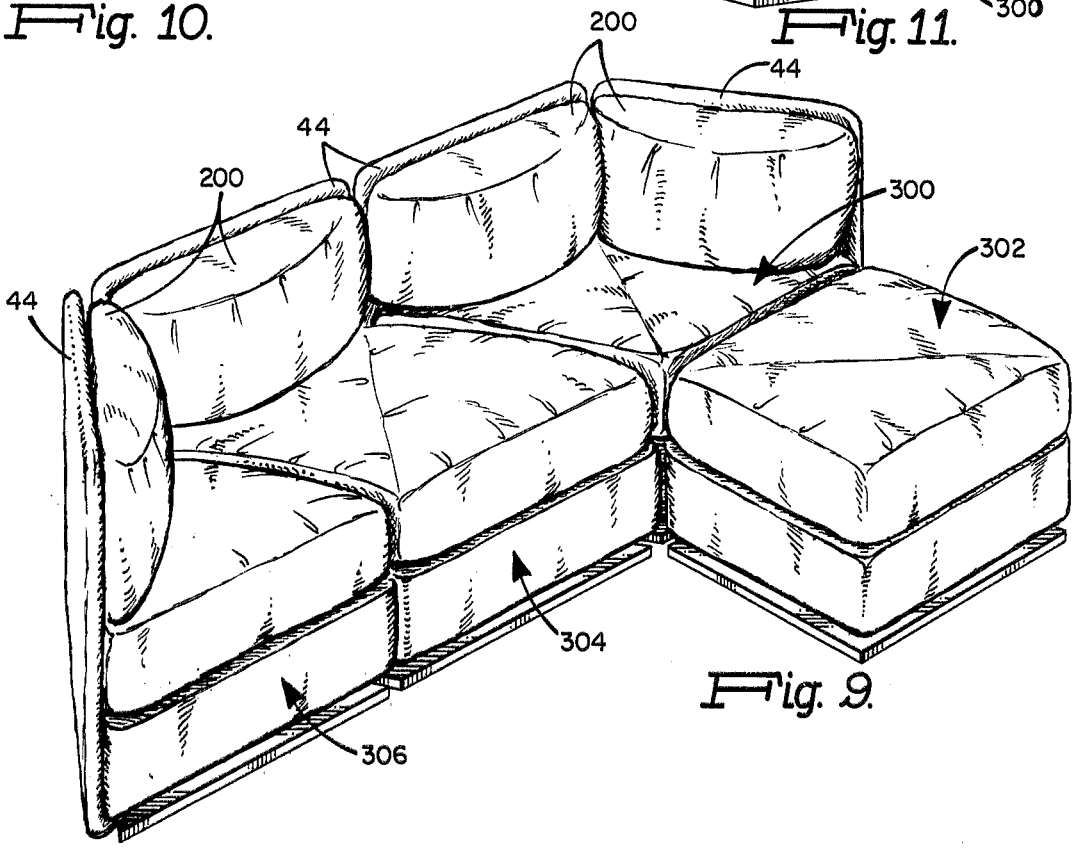
FIG. 9 is a perspective view of a modular article of furniture according to the present invention in which a triangular seatrest unit, two rhombus seatrest units and one square seatrest unit are associated with one another and with a plurality of upper body supports and pillows.

In FIGS. 9–13, there are shown various combinations of the seatrest units and upper body supports. Specifically, in FIG. 9, rhombus seatrest unit 300 is abutted on one side by square seatrest unit 302 and on another side by rhombus seatrest unit 304. Triangular seatrest unit 306 is abutted rhombus seatrest unit 304. The geometric seatrest units combined as shown in FIG. 9 provide a contiguous and easily changeable seating arrangement that may rest flush against a wall surface forming an obtuse angle. Also shown are upper body supports 44 associated with the sides of the geometric-shaped units to form a contiguous, upper body support held in releasably secured engagement to base 2 and in confronting unsecured relation to cushion support 33 of the completed modular article of furniture.

Disposed on the completed modular article of furniture shown in FIG. 9 are upper body support pillows 200 having substantially curved and tapered support surface 202 and substantially planar back surface 204, the length of the planar back surface being substantially equal to the width of the upper body support 44. The substantially curved and tapered support surface and the planar back surface allow the pillows to remain in stable contact relationship with one or more upper body supports, and further, be associated with one another to provide a contiguous back and side cushion support irrespective of any configuration and arrangement of the seatrest units.

Figure 10:
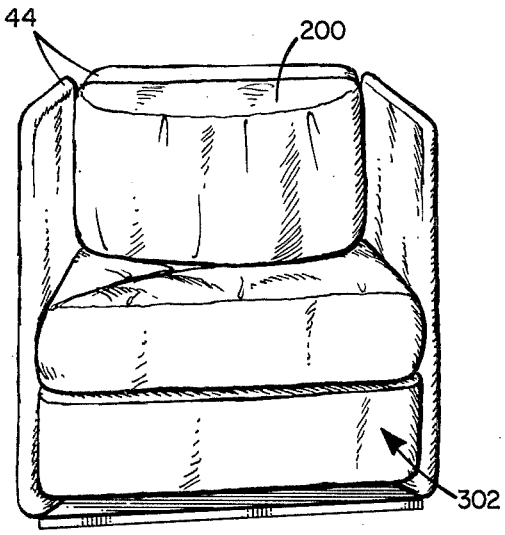
FIG. 10 is a perspective view of a modular article of furniture according to the present invention in which a single square seatrest unit is associated with three upper body supports to form a chair structure.
Figure 11:
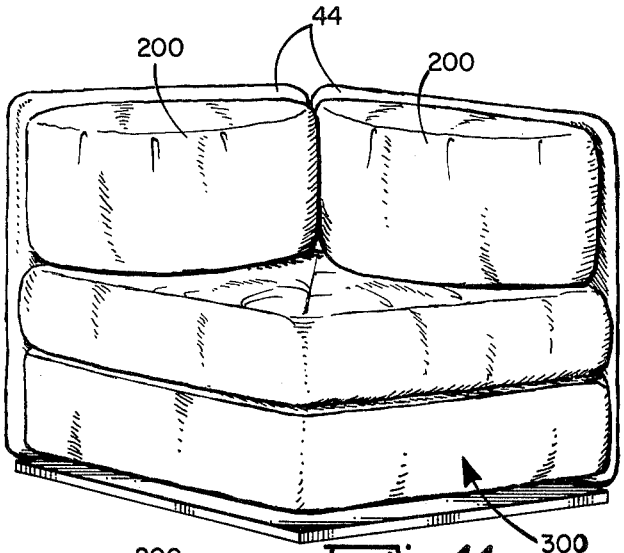
FIG. 11 is a perspective view of a modular article of furniture according to the present invention in which a rhombus seatrest unit is associated with two upper body supports to provide an alternative chair structure.

In FIG. 10 is shown a square seatrest unit having three upper body supports associated on three sides of the square seatrest unit to form a chair structure. FIGS. 11 and 12 again show the geometric seatrest units alone or in combination with one another and also with one or more upper body supports 40 to provide yet another versatile modular seating arrangement. Particularly in FIG. 11, rhombus seatrest unit 300 is combined with upper body support 40 to provide an alternative seat support unit that may rest flush against a wall surface forming an obtuse angle or acute angle. This modular article of furniture thus provides one geometric unit or article of furniture in which a user may rearrange the upper body supports to accommodate both an obtuse and acute wall configuration. The reverse curve arrangement in FIG. 12 comprises two square seatrest units 302 and two traingular seatrest units 306 combined with one another and with a plurality of upper body supports as shown to provide a modular article of furniture having two continuous seatrest units each facing in the opposite direction and having a contiguous backrest. This modular article of furniture thus provides with a minimum number of geometrically-shaped units a modular article of furniture that may be employed as a room divider.

As is apparent from FIGS. 9–12, and more specifically FIG. 13 where is shown a variety of possible modular configurations, the square, triangular and rhombus seatrest units allow a modular article of furniture to be constructed and rearranged to adapt to numerous spatial requirements and at the same time provide a contiguous seat and upper body structure with a minimum number of different geometrically-shaped units irrespective of the desired configuration.

While a specific embodiment has been shown and described, it should be understood that many modifications may be made therein. Accordingly, the appended claims should be construed to cover all equivalents falling within the true scope of the invention.

What is claimed is:

1. A modular article of furniture comprising:

a base of predetermined geometric configuration;

a seat support of predetermined geometric configuration;

means for supporting said seat support above said base in confronting spaced relationship to define a continuous, predetermined gap between the upper peripheral edge of said base and the lower peripheral edge of said seat support;

at least one upper body support having a lower support member;

means for supporting said seat support configured to allow selective insertion of said lower support member of said upper body support into said continuous, predetermined gap at any one of a plurality of positions along the peripheral edge of said base; and means within said gap for releasably securing said lower support member to said base.

2. A modular article of furniture comprising:

a generally planar base of predetermined geometric configuration;

a seat support of the same predetermined geometric configuration as said planar base;

means for supporting said seat support above said base in parallel confronting spaced relationship and with the peripheral edge of said base parallel to the peripheral edge of said seat support, to define a continuous, predetermined gap between the upper peripheral edge of said base and the lower peripheral edge of said seat support;

at least one upper body support having an upper body support frame and a lower support member;

said means for supporting said seat support configured to allow selective insertion of said lower support member of said upper body support into said predetermined gap at any one of a plurality of positions along the peripheral edge of said base; and means solely within said gap for releasably securing said lower support member to said base.

3. A modular article of furniture comprising:

a generally planar, multi-side base of predetermined geometric configuration;

a seat support of the same predetermined geometric configuration as said planar base;

means for supporting said seat support above said base in parallel confronting spaced relationship and with the sides of said base parallel to the sides of said seat support, to define a continuous, predetermined gap between the base and seat support and between each upper peripheral edge of each side of said base and each lower peripheral edge of each confronting side of said seat support;

at least one upper body support having an upper body support frame and a lower support member;

said means for supporting said seat support configured to allow selective insertion of said lower support member of said upper body support into said continous gap between any one of said upper and lower peripheral edges of the respective confronting sides of said base and seat support; and means within said gap for releasably securing said lower support member to said base in any one of said selective positions.

4. A modular article of furniture according to claim 3 wherein said seat support comprises:

a substantially planar plate of said predetermined geometric configuration;

a soft edged cushion support of said predetermined geometric configuration; and means for supporting said cushion support above said plate.

5. A modular article of furniture according to claim 3 wherein said seat support comprises:

a substantially planar plate of said predetermined geometric configuration;

a hard edged cushion support of said predetermined geometric configuration; and means for supporting said cushion support above said plate.

6. A modular article of furniture according to claim 3 wherein said means for supporting said seat support comprises:

an upper body support guide disposed between said base and said seat support and affixed thereto to provide said predetermined gap therebetween; and said upper body support guide including a plurality of support guide members outwardly extending toward the corners of said base and adapted to receive said lower support member therebetween.

7. A modular article of furniture according to claim 6 wherein at least one pair of said guide members are joined at ends thereof in the shape of a V with the joined ends disposed a predetermined distance from the sides of said planar base to guide said lower support member within said gap.

8. A modular article of furniture according to claim 3 wherein said securing means includes a plurality of securing means disposed to permit securing of said support member to any one or more sides of said planar base.

9. A modular article of furniture according to claim 3 wherein said lower support member of said upper body support is in the shape of a triangle having a base substantially equal in length to the side of said seat support and extending outwardly in substantially perpendicular relation from said upper body support frame.

10. A modular article of furniture according to claim 3 wherein said releasable securing means comprises:

a retaining bracket affixed to said base;

a securing rod integrally associated with said lower support member for releasably engaging said rod to said bracket.

11. A modular article of furniture according to claim 3 wherein said releasable securing means comprises:

a rotatable support rod integrally associated with said lower support member;

at least one cam disposed on and rotatable with said support rod for selective engagement with said base.

12. A modular article of furniture comprising:

a plurality of modular units in adjacent side-to-side relationship, each of said modular units having a predetermined, geometrically-shaped, horizontal cross-section, each of said horizontal cross-sections being selected from a group of shapes including a square, a triangle and a rhombus;

each of said modular units having horizontal sides of the same heighth and the same predetermined horizontal length to permit placement of a plurality of units in adjacent side-to-side relationship;

each modular unit further comprising:

a base of predetermined, geometric, horizontal, cross-sectional configuration;

a seat support of the same predetermined, geometric horizontal, cross-sectional configuration as said base;

means for supporting said seat support above said base with the lower surface of said seat support and the upper surface of said base in confronting spaced relationship to define a continuous, predetermined gap between each upper peripheral edge of each side of said base and each lower peripheral edge of each confronting side of said seat support;

at least one upper body support having a lower support member;

said means for supporting said seat support configured to allow insertion of said lower support member of said upper body support into said predetermined gap at selective distinct positions between each upper peripheral edge of each side of said base and each lower peripheral edge of each confronting side of said seat support; and means within said gap for releasably securing said lower support member to said base in any one of said selective positions.

13. A modular article of furniture asccording to claim 12 including:

a plurality of back support pillows each having an outwardly curved front support surface and a substantially planar back surface of the same horizontal length as said sides of said modular units;

said body support pillows disposed on top of said seat support in end-to-end relationship, and vertically supported by said seat support and further supported on said back surface by said upper body support; and said curved front support surface and said planar back surface joined to form tapered end portions to permit placement of a plurality of said pillows in adjacent end-to-end relationship to provide contiguous back support irrespective of the configuration of said modular article of furniture.

14. A modular article of furniture comprising:

a generally planar base of predetermined geometric configuration selected from the group of square, triangle and rhombus;

a seat support of the same predetermined geometric configuration as said planar base;

means for supporting said seat support above said base in parallel confronting spaced relationship and with the sides of said base parallel to the sides of said seat support, to define a continuous, predetermined gap between the base and seat support and between each upper peripheral edge of each side of said base and each lower peripheral edge of each confronting side of said seat support;

at least one upper body support having a generally rectangular upper body support frame formed of substantially continuous tubing, and a lower support member, said lower support member comprising a substantially V-shaped tubing element extending perpendicularly from the ends of the lower portion of said upper body support frame, and said upper body support frame being upholstered to form a substantially back support;

said means for supporting said seat support comprising:

guide members extending outwardly towards the corners of said base and joined at the inner ends thereof with the joined ends disposed inwardly from the sides of said planar base to provide a plurality of V-shaped support guides, said guide members being disposed between said base and said seat support and affixed thereto within said predetermined gap between said base and seat support;

said V-shaped support guides being configured to allow selective insertion of said V-shaped tubing element into said continuous gap between any one of said upper and lower peripheral edges of the respective confronting sides of said base and seat support;

a rotatable rod associated with and disposed within said V-shaped lower tubing element member;

retaining plates with openings therein affixed to the lower surface of said seat support; and a cam affixed to and rotatable with said rod; and said cam and said openings in each of said retaining plates being cooperative to provide releasable means to secure said upper body support when inserted between any respective ones of said confronting sides of said base and said seat support.

* * * * *